US005775799A

United States Patent [19]

Forkner

[11] Patent Number: 5,775,799

[45] Date of Patent: Jul. 7, 1998

[54] LIGHTING DEVICE INCORPORATING A ZOOMABLE BEAMSPREADER

[75] Inventor: John F. Forkner, South Laguna, Calif.

[73] Assignee: David W. Cunningham, Los Angeles, Calif.

[21] Appl. No.: 824,264

[22] Filed: Mar. 26, 1997

Related U.S. Application Data

[63] Continuation of Ser. No. 340,845, Nov. 17, 1994, abandoned.

[51] Int. Cl.[6] ..... F21V 5/00

[52] U.S. Cl. ..... 362/268; 362/281; 362/280; 362/328; 362/331

[58] Field of Search ..... 362/268, 275, 362/277, 280, 281, 282, 283, 285, 287, 328, 331, 332, 335, 336, 427, 428

[56] References Cited

U.S. PATENT DOCUMENTS

| | | | |
|---|---|---|---|
| 2,190,862 | 2/1940 | Condon . | |
| 3,267,279 | 8/1966 | Doolittle . | |
| 3,484,599 | 12/1969 | Little . | |
| 3,522,424 | 8/1970 | Fritsch | 362/268 |
| 3,665,179 | 5/1972 | McLintic . | |
| 4,293,892 | 10/1981 | Plummer | 362/17 |
| 4,316,241 | 2/1982 | Gulliksen | 362/268 |
| 4,345,303 | 8/1982 | Gerard et al. | 362/80 |
| 4,369,488 | 1/1983 | Brun | 362/268 |
| 4,598,345 | 7/1986 | Kleeman | 362/272 X |
| 4,930,051 | 5/1990 | Golz | 362/336 |
| 4,935,853 | 6/1990 | Collins | 362/272 |
| 4,972,306 | 11/1990 | Bornhorst | 362/281 |

*Primary Examiner*—Thomas M. Sember

*Attorney, Agent, or Firm*—Sheppard, Mullin, Richter & Hampton; James R. Brueggemann

[57] ABSTRACT

A zoomable beamspreader is disclosed having two lenses arranged in closely spaced, confronting relationship, with each lens incorporating an array of alternating positive and negative lens segments. One of the two lenses is controllably movable relative to the other, in a direction substantially perpendicular to an optical axis, between a non-spread position, in which the positive and negative lens segments of one lens are aligned with the respective negative and positive lens segments of the other lens, and a spread position, in which the positive and negative lens segments of one lens are aligned with the respective positive and negative lens segments of the other lens. The two lenses can take any of several alternative forms, including a one-dimensional array of cylindrical lens segments, for providing a zoomable beamspread along just one dimension, and a two-dimensional array of spheric or aspheric lens segments, for providing a zoomable beamspread along both dimensions.

36 Claims, 6 Drawing Sheets

LIGHTING DEVICE INCORPORATING A ZOOMABLE BEAMSPREADER

This application is a continuation of application Ser. No. 08/340,845, filed Nov. 17, 1994, now abandoned.

BACKGROUND OF THE INVENTION

This invention relates generally to beamspreaders for projecting a divergent beam of light and, more particularly, to beamspreaders that are configured to controllably vary the amount of the projected beam's divergence.

Beamspreaders of this particular kind have applications in numerous lighting fields, including for example the theater, television, rock and roll, and architectural lighting fields, where lighting fixtures are used to project light beams of controllably variable size onto a stage or other area. In the past, this has been achieved using lighting fixtures incorporating optical beamspreaders that either are highly inefficient or are relatively large and complex.

A simplified example of one prior art beamspreader is depicted in FIG. 1. It includes a lamp 101 and adjacent reflector 103, which are movably positioned relative to a fresnel lens 105. When the lamp and reflector are positioned relatively far from the fresnel lens, as shown by the solid lines in FIG. 1, a collimated beam 107 is produced. On the other hand, when the lamp and reflector are positioned relatively near to the fresnel lens, as shown by the dashed lines in FIG. 1, a divergent beam 109 is produced. This structure is considered unduly inefficient, because a significant amount of light emitted by the lamp fails to be collected by the lens, especially when a narrow field angle is being produced.

Other beamspreaders used in the past have included multiple lenses and have been relatively complex optically and mechanically. In addition, such beamspreaders are considered to be relatively cumbersome and heavy because of their length, and to be relatively expensive to manufacture.

Another potential application for beamspreaders of this particular kind is in the flash unit of a camera of the kind having a zoom lens or otherwise having a variable viewing angle. In such cameras, it is desirable for the projected light from the flash unit to have a beamwidth roughly comparable to that of the camera's view angle. However, no variable beamspreader having a sufficiently compact size and low cost is believed to have been available for applications of this kind.

In all of these applications, there is a need for the beamspreader to provide a controllably variable spread angle, while having a minimum size, complexity and cost. In many instances, this in turn will lead to a reduced size, complexity and cost for other components of the device into which the beamspreader is incorporated. In the case of a moving light lighting fixture, for example, reducing the size and complexity of the beamspreader can substantially reduce the size and complexity, and thereby the cost, of the mechanism for controllably directing the projected beam in a selected direction. The present invention satisfies this and other needs.

SUMMARY OF THE INVENTION

The present invention is embodied in a zoomable beamspreader that provides a variable spreading of an incident beam of light with a minimum number of components and with minimum complexity. The beamspreader includes first and second lenses, each having an array of alternating positive and negative lens segments. The two lenses are arranged in closely spaced, confronting relationship, to define an optical axis, and one of the lenses is controllably movable relative to the other in a direction substantially perpendicular to the optical axis. In a non-spread position, the positive and negative lens segments of one lens are aligned with the respective negative and positive lens segments of the other lens; on the other hand, in a spread position, the positive and negative lens segments of one lens are aligned with the respective positive and negative lens segments of the other lens. The two lenses preferably are constrained to move relative to each other only in the direction generally perpendicular to the optical axis.

When the two lenses are in the non-spread position, their effects effectively cancel each other out, and an incident beam of collimated light remains collimated after passing through the two lenses. Conversely, when the two lenses are in the spread position, their effects effectively reinforce each other, and an incident beam of collimated light is spread by roughly twice the amount that it would be spread by just a single lens. Intermediate amounts of beamspread, and thus a zoomable beamspread, are provided by controllably moving one lens relative to the other to a selected position intermediate the non-spread and spread positions.

The two lenses preferably have surfaces that are free of any slope discontinuities, and in particular have surfaces that provide a thickness that varies substantially sinusoidally. The relatively thick portions constitute the positive lens segments, and the relatively thin portions constitute the negative lens segments.

The two lenses of the zoomable beamspreader can take any of several alternative forms, including a one-dimensional array of cylindrical lens segments and a two-dimensional array of spheric or aspheric lens segments. In the one-dimensional array case, the amount of beamspread is variable along just a single dimension. The individual positive and negative cylindrical lens segments preferably all have substantially the same transverse width, and one of the lenses is controllably movable relative to the other lens by an amount corresponding to at least that transverse width.

In the two-dimensional array case, on the other hand, the amount of beamspread is controllably variable in two dimensions. In one form, the individual lens segments are generally rectangular and arranged along orthogonal transverse axes. Controllably moving one of the two lenses relative to the other along one transverse axis varies the amount of beamspread in one dimension, while controllably moving one of the two lenses relative to the other along the other transverse axis varies the amount of beamspread in the other dimension.

In another form of two-dimensional array, the individual lens segments are arranged in a polar configuration, with orthogonal radial and circumferential axes. A centerline thereby is defined in each lens, and the two lenses are oriented with their centerlines substantially aligned with each other. One of the two lenses is controllably rotatable relative to the other, about the substantially aligned centerlines, to vary the amount of beamspread simultaneously in two dimensions. In this polar configuration, the two lenses have thicknesses that vary substantially sinusoidally along both the radial axis and the circumferential axis. The amplitude and period of this substantially sinusoidal thickness variation increase with increasing radius. In addition, each of the two lenses preferably includes at its center a single, substantially circular, spheric or aspheric lens segment, concentric with the lens centerline.

Other features and advantages of the invention should become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
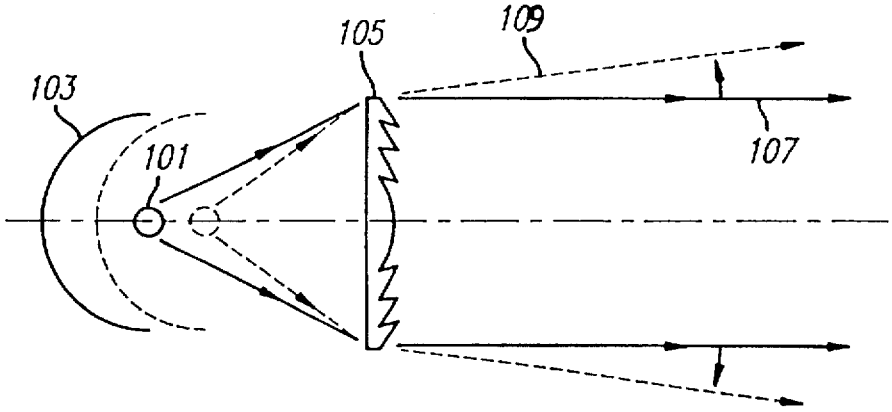
FIG. 1 PRIOR ART
FIG. 1 is a schematic drawing of a prior art beamspreader that incorporates a lamp/reflector assembly that is controllably movable toward and away from a fresnel lens, to provide a zoomable beamspread.
Figure 2:
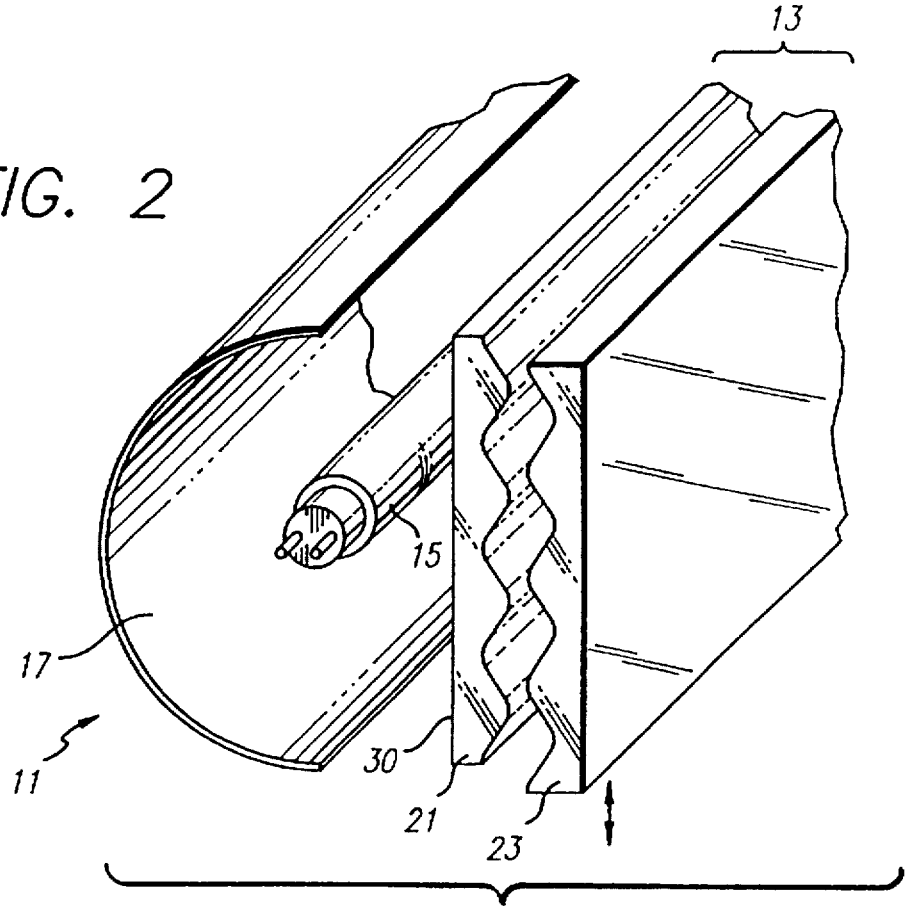
FIG. 2 is a perspective view of a first embodiment of a zoomable beamspreader in accordance with the invention, which incorporates two confronting lenses having alternating positive and negative cylindrical lens segments, for providing a beamspread that is controllably zoomable in just one dimension.
Figure 3A:
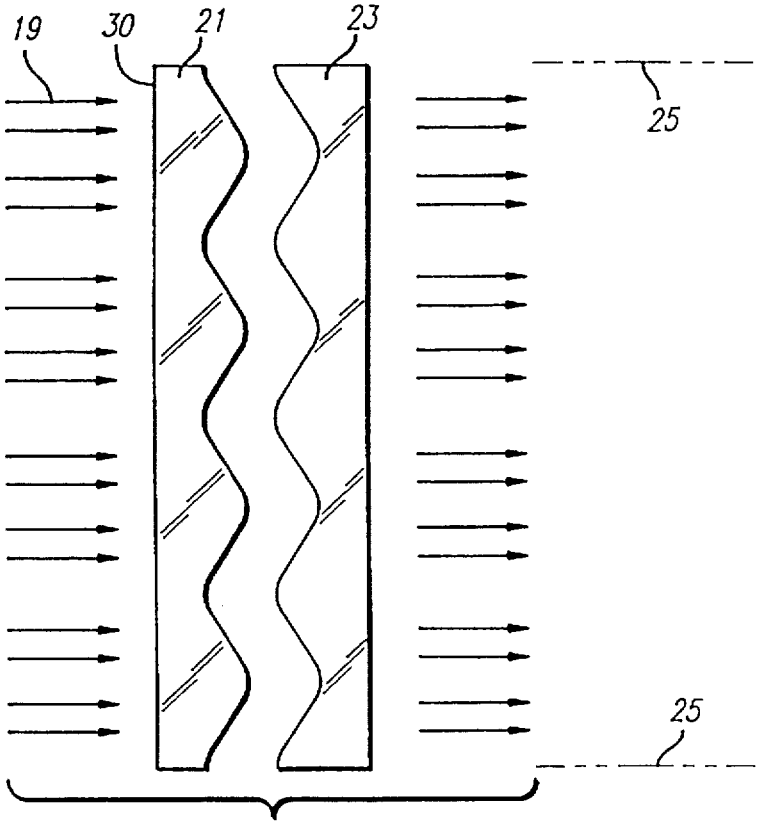
FIG. 3A is a schematic drawing that shows how an incident beam of collimated light remains collimated after passing through the two lenses of the zoomable beamspreader of FIG. 2, when the lenses are in their non-spread position.
Figure 3B:
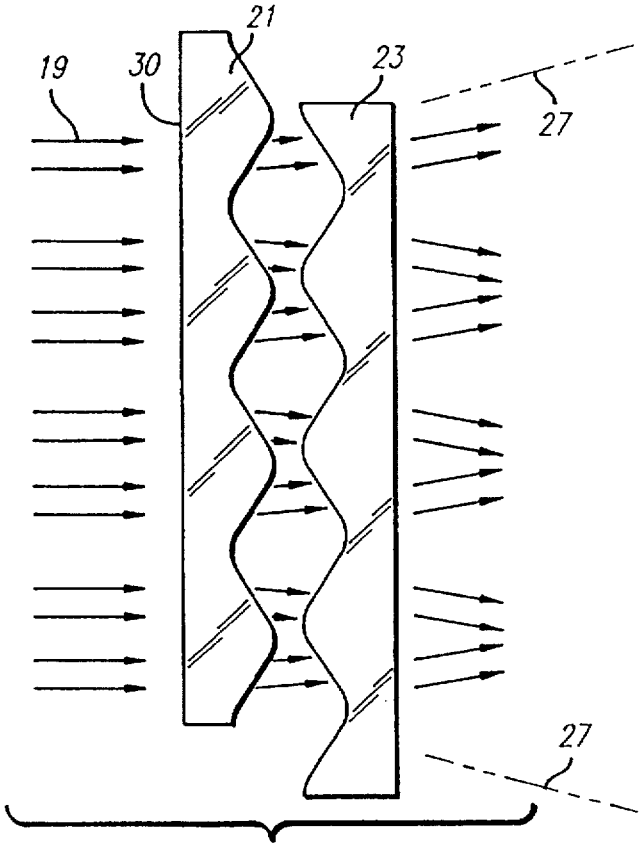
FIG. 3B is a schematic drawing similar to FIG. 3A, but showing how an incident beam of collimated light is spread when the two lenses are in their spread position.

With reference now to the drawings, and particularly to FIGS. 2, 3A and 3B, there is shown a first embodiment of a lighting fixture 11 incorporating a zoomable beamspreader 13 in accordance with the invention. The lighting fixture includes an elongated, linear light tube 15 positioned at the focus of a cylindrical parabolic reflector 17 so as to produce a generally collimated beam of light 19 that is directed forwardly toward the beamspreader. The beamspreader includes a first generally planar lens 21 and a second generally planar lens 23, closely spaced to and confronting the first lens, for spreading the beam by a controllable amount in a direction perpendicular to the longitudinal axes of the light tube and the reflector.

The first lens 21 and the second lens 23 are each rectangular, with one surface that is generally planar and another surface that is uniform in a direction parallel with the longitudinal axes of the light tube 15 and the reflector 17, but wave-like, or sinusoidal, in a transverse direction. The lens thickness therefore varies generally sinusoidally along that transverse axis, with alternating positive and negative lens segments of equal size and power. The positive lens segments correspond to the relatively thick portions, and the negative lens segments correspond to the relatively thin portions.

The two lenses 21 and 23 are positioned immediately adjacent to each other, in the path of the beam 19 of generally collimated light reflected by the reflector and generally perpendicular to that collimated light. The positive lens segments of each lens function to converge incident parallel light, and the negative lens segments of each lens function to diverge such light. The combined effect is that the positive and negative lens segments contribute substantially equally in spreading the beam. Each lens, by itself, thus would function to diverge, or spread, the beam by a fixed amount; however, the two lenses, together, can function to provide a beamspread that is zoomable.

One of the first and second lenses 21 and 23, respectively, is adapted to be controllably movable relative to the other lens in the direction of the sinusoidal thickness variation. The range of movement is at least equal to the transverse widths of the positive and negative lens segments.

When the two lenses 21 and 23 are positioned in a non-spread position, shown in FIG. 3A, with the positive and negative lens segments of the first lens 21 aligned with the respective negative and positive lens segments of the second lens 23, the effects of the two lenses will cancel each other out and the beam will emerge from the second lens still substantially collimated. This is depicted by the reference lines 25 in FIG. 3A. On the other hand, when the two lenses are positioned in a spread position, shown in FIG. 3B, with the positive and negative lens segments of the first lens aligned with the respective positive and negative lens segments of the second lens, the effects of the two lenses will reinforce each other and the beam will emerge from the second lens with a maximum amount of spread. This is depicted by the reference lines 27 in FIG. 3B.

Intermediate amounts of beamspread can be provided by controllably positioning the movable lens at a position intermediate its two extreme positions, i.e., the non-spread position of FIG. 3A and the spread position of FIG. 3B. Thus, an entire range of beamspread can be provided merely by controllably moving one of the two lenses 21 and 23 by a relatively small amount corresponding to the transverse width of one lens segment. In addition, no movement of either lens along the axis of the projected beam of light is required. This results in a very compact, lightweight and inexpensive mechanical structure for moving the movable lens. Moreover, since the positive and negative lens segments of the two lenses flow continuously into each other, abrupt slope changes that would be difficult to mold and that would unduly scatter light are avoided.

It will be appreciated that some of the light that reaches the first lens 23 from the lamp 15 without being reflected by the reflector 17 will be projected outside the field of the projected beam. To prevent such light from creating a perceptible light pattern outside that field, the flat surface 28 of the first lens 23 is conditioned to provide an appropriate amount of diffusion.

The beamspreading effect of each of the lenses 21 and 23 can be computed approximately by treating the lens as made up of adjacent circular cylinder lens segments. If all of such lens segments have the same radius of curvature, R, and the same semi-width, W, and if the lens's refractive index is N, then the focal length, F, of each lens segment is given by the following formula:

$$F=R/(N-1)$$

The approximate beamspread, B, produced by each lens segment is then given by the following formula:

$$B=2W/F \text{ (radians)}$$

The maximum thickness variation, D, then can be approximated by the following formula:

$$D=W^2/R$$

It is convenient to describe the surface curvature of the lenses 21 and 23 in terms of sine wave functions. The surface curvature, Z, is given by the following formula, where X is the lens's vertical dimension:

$$Z=(D/2)\cos(\pi X/2W)$$

The beamspread angle, B, produced by this sinusoidal surface is equal to the maximum slope multiplied by 2(N−1), or:

$$B=\pi D(N-1)/2W$$

The maximum beamspread produced by the two lenses 21 and 23, in combination, would be approximately twice that value, or $\pi D(N-1)/W$.

It will be appreciated that the beamspreader 13 of FIGS. 2, 3A and 3B functions to spread the projected beam of light along only one dimension, i.e., vertically in the drawings. The spread of the beam remains substantially unaffected along the orthogonal dimension, i.e., horizontally in the drawings. In many applications, however, it is desirable to spread the beam along both vertical and horizontal dimensions. Such a two-dimensional beamspread can be achieved using a beamspreader having two lenses with alternating positive and negative lens segments arranged in a two-dimensional array. Several embodiments of such a two-dimensional beamspreader are described below.

Figure 4:
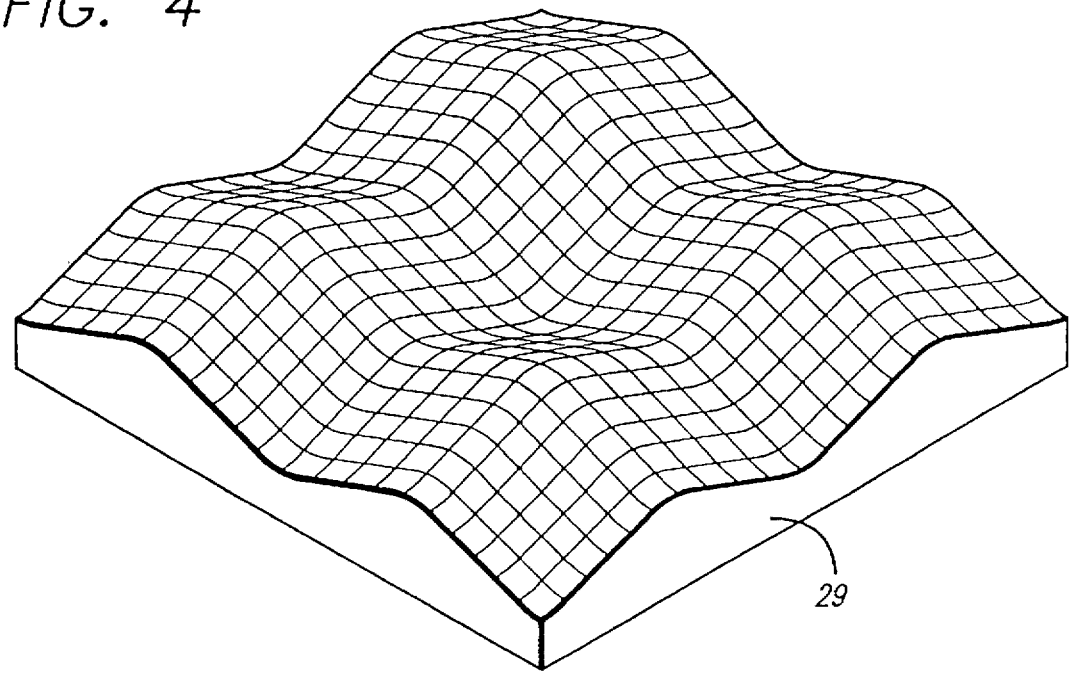
FIG. 4 is a perspective view of a fragment of one of two identical lenses that can be incorporated into a second embodiment of the invention, these lenses arranging a plurality of alternating positive and negative lens segments in an X-Y pattern, for providing a beamspread that is controllably zoomable independently in two dimensions.

FIG. 4 depicts a fragment of a lens 29 incorporating alternating positive and negative lens segments arranged in an X-Y, or rectangular, array. Each lens segment thus has a rectangular shape, and it is surrounded on its four sides by lens segments of the opposite power. In use, the lens is positioned in closely spaced, confronting relationship to a similarly configured lens (not shown), and a mechanism is provided for controllably moving one of the two lenses laterally relative to the other lens along two orthogonal axes. Moving the lens along one axis affects beamspread in one dimension, and moving the lens along the other axis affects beamspread in the other dimension. It will be appreciated that the amount of beamspread provided in each dimension depends on the relative positioning of the positive and negative lens segments of the two lenses, in the same manner as with the one-dimensional lenses of FIGS. 2, 3A and 3B.

A two-dimensional beamspreader incorporating lenses like the lens 29 of FIG. 4 can be configured to controllably move one lens relative to the other independently along its two axes, so as to provide independent control of the amount of beamspread in both dimensions. Alternatively, the movement can be constrained to a diagonal relative to the lens's two axes, so that the beamspread in the two dimensions is controlled simultaneously.

The surface depth, Z, of the lens 29 of FIG. 4, in the case of a square beamspread, is given by the following formula, where the variables X and Y correspond to the distances along orthogonal axes of the lens and the constants D and W are as defined above in connection with the one-dimensional lenses 21 and 23:

$$Z=(D/2)\cos(\pi X/2W)+(D/2)\cos(\pi Y/2W)$$

Changing the values of D and/or W of the X term relative to the Y term will produce a non-square, rectangular beamspread pattern.

Control of the beam pattern throughout the zoom range can be exercised by modifying the above equation so that adjacent lens surface peaks have somewhat different heights, D, while maintaining the same spacing parameter, W. This can be achieved by expanding the amplitude term of the sine wave so as to produce amplitude damping of the waveform. The equation describing the surface then takes the form of the following formula:

$$Z=(C_1X+C_2)\cos(\pi X/2W_1)+(C_3Y+C_4)\cos(\pi Y/2W_2)$$

The constants $C_1$, $C_2$, $C_3$ and $C_4$ allow the lens surface peaks to be spaced differently in the X and Y directions (using $W_1$ and $W_2$) and also allow different rates of change of the peak amplitudes in the X and Y directions through the selections of these constants. Additional fine control of the beamspread during zooming can be provided by adding higher order spatial harmonic terms to the surface equation. Omitting the damping and anamorphic terms in the above equation for clarity, the surface equation with a first order harmonic becomes the following:

$$Z=(D)\cos(\pi X/2W)+(K_1D)\cos(3\pi/2W)+(D)\cos(\pi Y/2W)+(K_2D)\cos(3\pi/2W)$$

The constants $K_1$ and $K_2$ can be used to modify the basic sine wave shape into some other form that produces the desired beam pattern during zooming.

It will be appreciated that the lens 29 of FIG. 4 could be modified to include cylindrical lens segments on both of its surfaces. The axis of the cylindrical lens segments on one surface would be orthogonal to the axis of the cylindrical lens segments on the other surface. The thickness at each point on this modified lens would correspond to the thickness of the corresponding point on the lens of FIG. 4.

Figure 5:
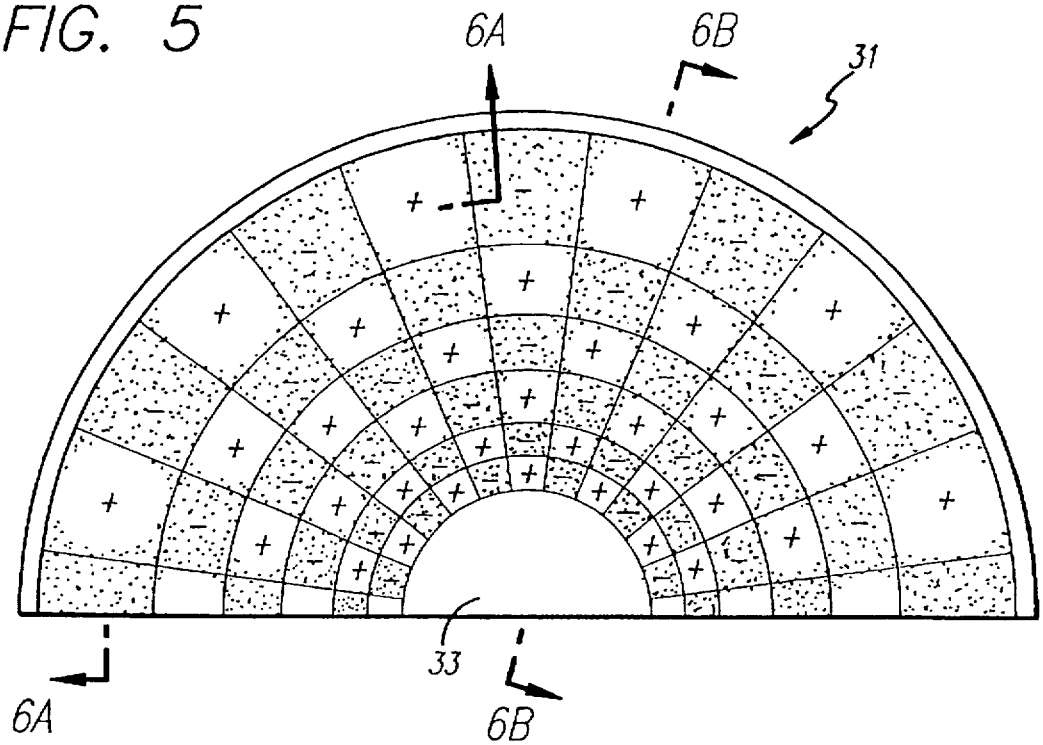
FIG. 5 is a schematic plan view of a portion of one of two identical lenses that can be incorporated into a third embodiment of the invention, these lenses arranging a plurality of alternating positive and negative lens segments in a polar array, for providing a beamspread that is controllably zoomable simultaneously in two dimensions.

FIG. 5 depicts a portion of another lens 31 incorporating alternating positive and negative lens segments arranged in a two-dimensional array, this lens being circular and arranging the lens segments in a polar array. In particular, the lens segments are arranged along orthogonal radial and circumferential axes, and each lens segment is surrounded on its four sides by lens segments of the opposite power. In use, the lens is positioned in closely spaced, confronting relationship to a similarly configured lens (not shown), with their centerlines substantially aligned with each other. To effect the beamspread, a suitable mechanism controllably rotates one of the two lenses relative to the other, about their aligned centerlines.

As with the beamspreader lenses described above, the lens 31 of FIG. 5 has a thickness that varies substantially sinusoidally along both the radial axis and the circumferential axis. The relatively thick regions constitute the positive lens segments, and the relatively thin lens segments constitute the negative lens segments. These positive and negative lens segments are identified by the symbols + and −, respectively, in FIG. 5.

A beamspreader incorporating two lenses like the lens 31 of FIG. 5 provides a zoomable beamspread for a circular beam of light. When the lenses are positioned relative to each other with the positive and negative lens segments of one lens aligned with the respective negative and positive lens segments of the other lens, substantially no beam spread will be provided. Conversely, when the lenses are positioned with the positive and negative lens segments of one lens aligned with the respective positive and negative lens segments of the other lens, a maximum amount of beamspread will be provided.

It is desirable for the individual lens segments to have a generally square shape, i.e., with their radial dimension substantially equal to their circumferential dimension. Since each lens segment in the depicted lens 31 spans about 15 degrees of arc along the circumferential axis, the circumferential dimension of the lens segments increases with increasing radius. Consequently, as shown in FIG. 5, it is advantageous for the period of the sinusoidal thickness variation along the radial axis to increase generally linearly with increasing radius.

Figure 6A:
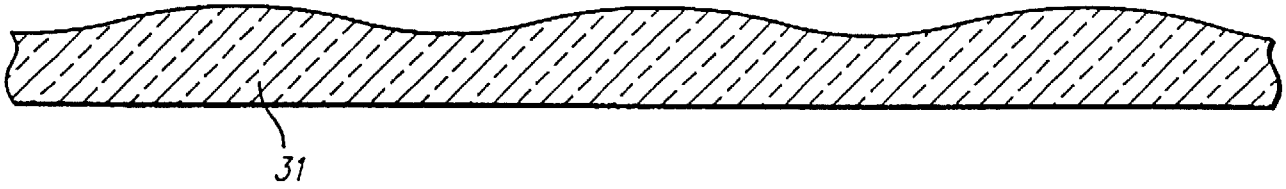
FIG. 6A is a cross-sectional view of the lens of FIG. 5, taken substantially in the direction of the arrows 6A—6A in FIG. 5.
Figure 6B:
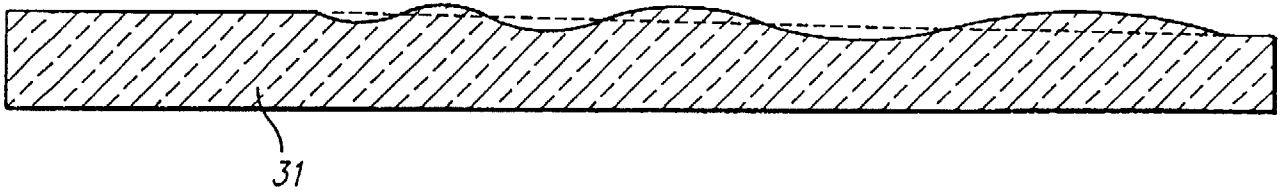
FIG. 6B is a cross-sectional view of the lens of FIG. 5, taken substantially in the direction of the arrows 6B—6B in FIG. 5.

At the same time, since comparable amounts of beamspread are desired to be provided by each lens segment, it is advantageous for the magnitude of the sinusoidal thickness variation to increase generally linearly with increasing radius. This effect is depicted in FIG. 6B, which is a radial sectional view of the lens 31 of FIG. 5.

The sinusoidal thickness variation of the lens 31 along the circumferential axis will inherently follow this same pattern. In particular, the magnitude of this sinusoidal variation will increase generally linearly with radius. Thus, the innermost ring of lens segments has the smallest thickness variation along the circumferential axis, and the outermost ring of lens segments has the largest thickness variation along this same axis. The sinusoidal thickness variation of the outermost ring of lens segments is depicted in FIG. 6A.

Inasmuch as the lens segments decrease in size as they approach the centerline of the lens 31, a point is reached at which they are no longer practically formed. The lens, therefore, includes a circular center section 33 having the form of a straightforward spheric or aspheric lens.

The surface of the lens 31 can be described by the following formula:

$$Z=(C_1R-C_2)\sin(C_3R-C_4R^2-C_5)\sin(C_6A)$$

The constants $C_1$ and $C_2$ control the decreasing amplitude of the lens surface peaks toward the center of the lens. The constants $C_3$, $C_4$ and $C_5$ decrease the spacing of the peaks toward the center of the lens. Finally, the constant $C_6$ controls the angular spacing of the lens peaks around the circumference.

Special mention should be made of the shape of the lens surface in the region of the common corner of each set of four contiguous lens segments. In each case, two of those lens segments will be convex, or positive, and the other two lens segments will be concave, or negative. The surface in this region, therefore, will have the general shape of a saddle. In particular, the shape is concave along an axis interconnecting the centers of the two positive lens segments and convex along an axis interconnecting the centers of the two negative lens segments. These saddle-shaped regions contribute to the beamspreading to the same extent as do the remaining portions of the lens segments.

Figure 7:
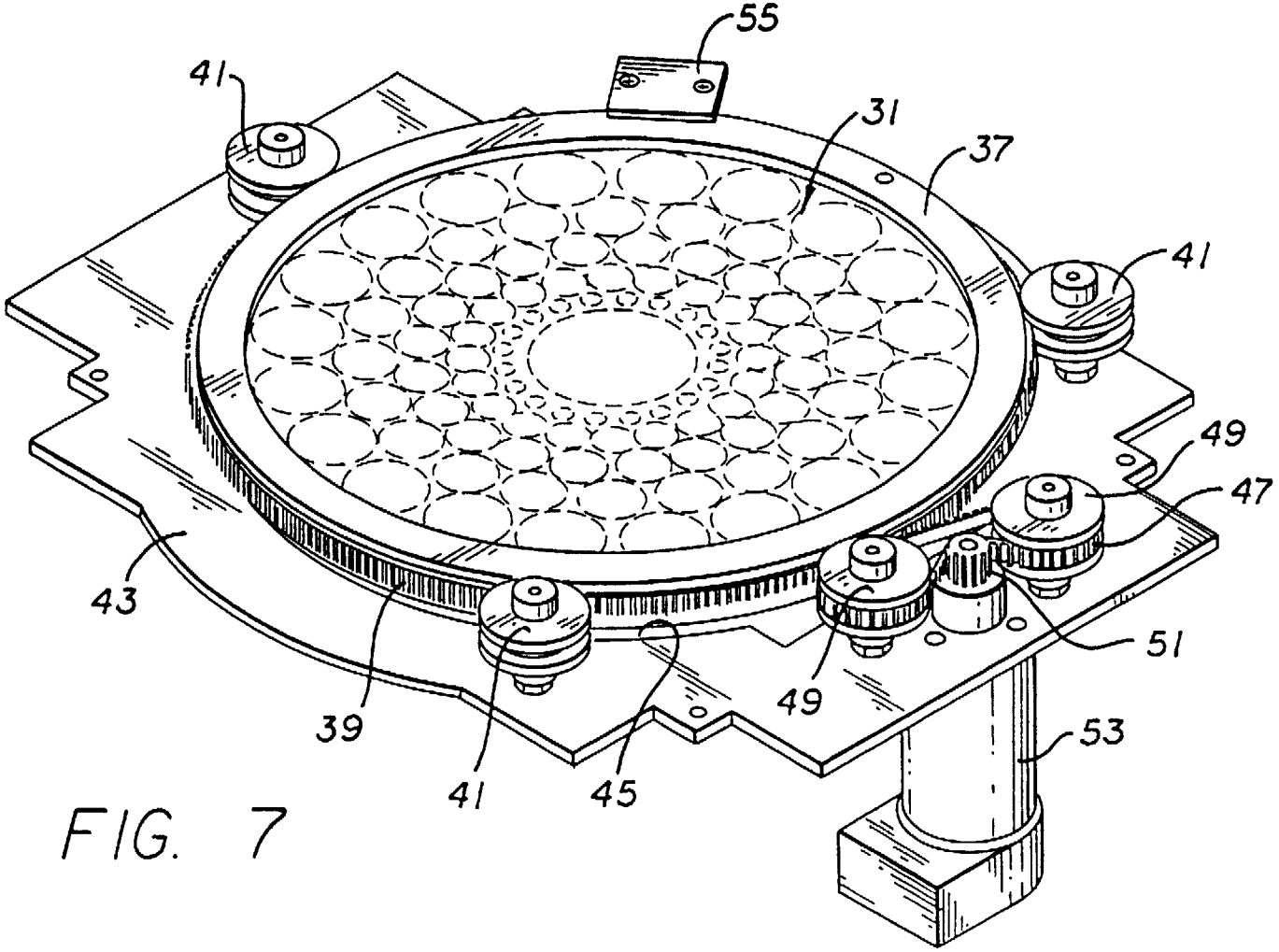
FIG. 7 is a perspective view of a drive assembly for controllably rotating the lens of FIG. 5 relative to a similar, fixed lens located immediately beneath it.

FIG. 7 depicts one suitable mechanism for controllably rotating one lens 31 of the beamspreader relative to the other lens (not shown), which is located immediately below the depicted lens 31. The mechanism includes a metallic ring 37 for supporting the lens 31 along the lens's periphery, with gear teeth 39 being formed completely around the ring's outer surface. The lens/ring assembly is supported for rotation by three idler wheels 41 that are rotatably mounted on a support plate 43. A circular aperture 45 in the support plate allows light to be transmitted through the lenses.

A toothed belt 47 is wrapped around two further idler wheels 49 and driven by a pinion gear 51 that, in turn, is controllably driven by an electric motor 53. One of the idler wheels 55 is positioned in proximity to the lens ring 37, such that the toothed belt engages the gear teeth 39. Controlled rotation of the motor thereby rotates the lens ring and the lens 31. A conventional Hall effect sensor 55 senses the relative position of the lens/ring assembly. The design of a suitable control system for driving the motor based on the signal supplied by the Hall effect sensor, so as to controllably rotate the lens/ring assembly and provide the desired amount of beamspread is well within the capabilities of those skilled in the relevant art.

The beamspreader of FIGS. 5 and 7 is suitable for use in lighting fixtures commonly used in theater, television, rock and roll, and architectural lighting applications. A beamspread that is controllably variable, or zoomable, over a wide angular range is provided simply by rotating one of the beamspreader's two lenses through as little as 15 degrees of arc. This is particularly advantageous in the case of a so-called moving light lighting fixture.

Figure 8:
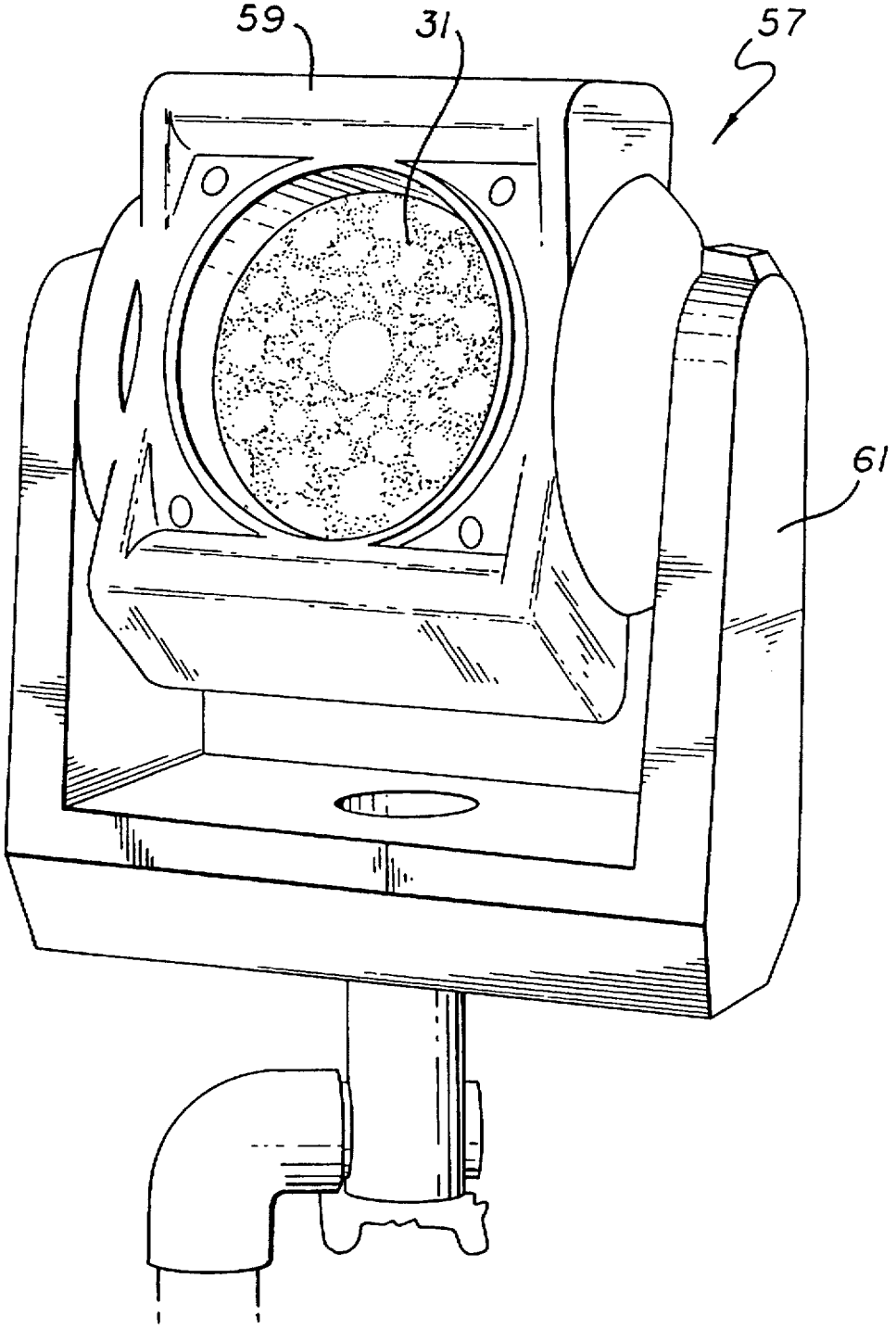
FIG. 8 is a perspective view of a moving light lighting fixture incorporating a zoomable beamspreader having a pair of lenses like the lens of FIG. 5, for providing a beamspread that is controllably zoomable simultaneously in two dimensions.

An example of such a moving light lighting fixture 57 is depicted in FIG. 8. The fixture is configured to project a high-intensity, zoomable beam of light in any desired direction, and to vary that direction in a rapid fashion, under remote control. The fixture includes a housing 59 mounted in a yoke 61 for motorized rotation about a generally horizontal axis, so as to control the projected beam's elevation. The yoke is configured for motorized rotation about a generally vertical axis, so as to control the projected beam's azimuth. The beamspreader of the invention is particularly advantageous for use in this fixture, because the beamspreader's compactness and light weight allow the fixture's elevation and azimuth drive mechanisms to be simplified.

It should be appreciated from the foregoing description that the present invention provides an improved zoomable beamspreader that spreads a beam of light by a controlled amount with minimal complexity. The beamspreader includes two lenses, each having an array of alternating positive and negative lens segments, and one lens is movably laterally relative to the other between a non-spread position, in which the positive and negative lens segments of one lens are aligned with the respective negative and positive lens segments of the other lens, and a spread position, in which the positive and negative lens segments of one lens are aligned with the respective positive and negative lens segments of the other lens. One-dimensional arrays can be used to spread a beam in just one dimension, and two-dimensional arrays can be used to spread a beam in both dimensions.

Although the invention has been disclosed with reference only to the presently preferred embodiments, those skilled in the art will appreciate that various modifications can be made without departing from the invention. Accordingly, the invention is defined only by the following claims.

I claim:

1. A zoomable beamspreader comprising:

a first lens having an array of alternating positive and negative lens segments; and second lens having an array of alternating positive and negative lens segments;

wherein the positive lens segments are each configured to converge incident parallel light rays, and the negative lens segments are each configured to diverge incident parallel light rays:

wherein the first and second lenses are arranged in confronting relationship, to define an optical axis;

wherein one of the first and second lenses is configured to be controllably movable relative to the other lens in a direction substantially perpendicular to the optical axis, between a non-spread position, in which the positive and negative lens segments of the first lens are aligned with the respective negative and positive lens segments of the second lens, and a spread position, in which the positive and negative lens segments of the first lens are aligned with the respective positive and negative lens segments of the second lens, and wherein movement between the spread and non-spread positions alters the beamspread of a beam of light passing through the beamspreader along the optical axis, without substantially altering the beam's direction.

2. A zoomable beamspreader as defined in claim 1, wherein the positive and negative lens segments of the first lens have a size and power substantially equal to that of the positive and negative lens segments of the second lens, such that when the lenses are in the non-spread position a collimated beam of light incident on the first lens will be substantially collimated after exiting the second lens, and such that when the lenses are in the spread position a collimated beam of light incident on the first lens will be spread by a maximum amount after exiting the second lens.

3. A zoomable beamspreader as defined in claim 2, wherein both the first lens and the second lens have thicknesses that vary substantially sinusoidally, with the relatively thick portions constituting the positive lens segments and with the relatively thin portions constituting the negative lens segments.

4. A zoomable beamspreader as defined in claim 1, wherein the alternating positive and negative lens segments of both the first lens and the second lens are cylindrical and arranged in a linear, side-by-side array.

5. A zoomable beamspreader as defined in claim 4, wherein:

the alternating positive and negative lens segments of both the first lens and the second lens all have substantially the same transverse width; and one of the first and second lenses is movable relative to the other in a direction orthogonal to the optical axis by an amount corresponding to the transverse widths of the positive and negative lens segments of the first and second lenses.

6. A zoomable beamspreader as defined in claim 1, wherein the alternating positive and negative lens segments of the first and second lenses are arranged in a two-dimensional array.

7. A zoomable beamspreader as defined in claim 6, wherein:

the alternating positive and negative lens segments of the first and second lenses are rectangular and are arranged in a two-dimensional array having perpendicular first and second axes; and one of the first and second lenses is controllably movable relative to the other lens, along the first and second axes, to controllably adjust the spread angle of an incident collimated beam of light in two dimensions.

8. A zoomable beamspreader as defined in claim 6, wherein:

the alternating positive and negative lens segments of both the first lens and the second lens are arranged in a polar configuration having orthogonal radial and circumferential axes, with a lens centerline thereby being defined in each lens;

the first and second lenses are oriented with their centerlines substantially aligned with each other; and one of the first and second lenses is controllably rotatable relative to the other, about the substantially aligned lens centerlines, to controllably adjust the spread angle of an incident collimated beam of light.

9. A zoomable beamspreader as defined in claim 8, wherein the first lens and second lenses each have thicknesses that vary substantially sinusoidally along both the radial axis and the circumferential axis.

10. A zoomable beamspreader as defined in claim 9, wherein the substantially sinusoidal thickness variation of the first and second lenses along their radial axes has both an amplitude and a period that increase with increasing radius.

11. A zoomable beamspreader as defined in claim 8, wherein the first lens and the second lens each further include a substantially circular lens segment concentric with the lens centerline.

12. A zoomable beamspreader as defined in claim 1, wherein the first and second lenses each have two surfaces that are substantially free of any slope discontinuities.

13. A zoomable beamspreader as defined in claim 1, wherein one of the first and second lenses is controllably movable relative to the other lens to a selected position between the non-spread position and the spread position, to provide a selected amount of beamspread to an incident beam of collimated light.

14. A zoomable beamspreader as defined in claim 1, wherein the first and second lenses are constrained to movement relative to each other only in a direction substantially perpendicular to the optical axis.

15. A zoomable beamspreader as defined in claim 1, and further comprising:

a lamp;

a concave reflector positioned in a predetermined position relative to the lamp such that the lamp and reflector combine to produce a beam of light;

a support structure for supporting the lamp and the reflector in a predetermined position relative to the first and second lenses, such that the beam of light is directed toward the first and second lenses, whereupon the lenses function to spread the beam of light by a controllable amount.

16. A lighting fixture for projecting a beam of light having a beamspread that is selectively zoomable, comprising:

a lamp;

a concave reflector positioned in a predetermined position relative to the lamp such that the lamp and reflector combine to produce a beam of light centered on an optical axis;

a first lens having a two-dimensional array of alternating positive and negative lens segments;

second lens having a two-dimensional array of alternating positive and negative lens segments, substantially identical to the positive and negative lens segments to the first lens;

wherein the positive lens segments are each configured to converge incident parallel light rays, and the negative lens segments are each configured to diverge incident parallel light rays:

wherein the first and second lenses are arranged in closely spaced, confronting relationship, in the path of the beam of light produced by the lamp and reflector, substantially aligned with the optical axis; and a drive mechanism for controllably moving one of the first and second lenses relative to the other lens, in a direction substantially perpendicular to the optical axis, between a non-spread position, in which the positive and negative lens segments of the first lens are aligned with the respective negative and positive lens segments of the second lens, and a spread position, in which the positive and negative lens segments of the first lens are aligned with the respective positive and negative lens segments of the second lens, wherein movement between the spread and non-spread positions alters the beamspread of a beam of light passing through the beamspreader along the optical axis, without substantially altering the beam's direction.

17. A lighting fixture as defined in claim 16, wherein:

the first and second lenses are both circular and have alternating positive and negative lens segments arranged in a polar configuration, with orthogonal radial and circumferential axes;

the first and second lenses are positioned in the path of the beam of light produced by the lamp and reflector, substantially concentric with the optical axis; and the drive mechanism controllably rotates one of the first and second lenses about the optical axis.

18. A lighting fixture as defined in claim 17, wherein the first and second lenses each have thicknesses that vary substantially sinusoidally along both the radial axis and the circumferential axis.

19. A lighting fixture as defined in claim 18, wherein the substantially sinusoidal thickness variation of the first and second lenses along their radial axes has both an amplitude and a period that increase with increasing radius.

20. A lighting fixture as defined in claim 16, wherein the first and second lenses each further include a substantially circular lens segment concentric with the optical axis.

21. A lighting fixture as defined in claim 17, and further including:

a housing that houses the lamp, the reflector, and the first and second lenses;

a yoke that supports the housing for controlled rotation about a substantially horizontal axis; and a support that supports the yoke for controlled rotation about a substantially vertical axis;

whereby the lighting fixture can be conditioned to project a zoomable beam of light in any selected direction.

22. A zoomable beamspreader comprising:

a first lens having an array of alternating positive and negative lens segments; and a second lens having an array of alternating positive and negative lens segments;

wherein the positive lens segments are each configured to converge incident parallel light rays and the negative lens segments are each configured to diverge incident parallel light rays:

the first and second lenses are arranged in confronting relationship, to define an optical axis;

and wherein at least one of the first and second lenses is configured to be controllably movable relative to the other lens in a direction substantially perpendicular to the optical axis, to alter the beamspread of a beam of light passing through the beamspreader along the optical axis, such that the beamspreading effect of each lens reinforces that of the other lens, to produce a beamspread wider than the beamspread produced by either lens by itself, without substantially altering the beam's direction.

23. A zoomable beamspreader as defined in claim 22, wherein at least one of the first and second lenses is configured to be controllably movable relative to the other lens in a direction substantially perpendicular to the optical axis, between a non-spread position, in which the positive and negative lens segments of the first lens are aligned with the respective negative and positive lens segments of the second lens, and a spread position, in which the positive and negative lens segments of the first lens are aligned with the respective positive and negative lens segments of the second lens.

24. A zoomable beamspreader as defined in claim 22, wherein the positive and negative lens segments of the first lens have a size and power substantially equal to that of the positive and negative lens segments of the second lens, such that when the lenses are in a non-spread position, with the positive and negative lens segments of the first lens aligned with the respective negative and positive lens segments of the second lens, a collimated beam of light incident on the first lens will be substantially collimated after exiting the second lens.

25. A zoomable beamspreader as defined in claim 24, wherein both the first lens and the second lens have thicknesses that vary substantially sinusoidally, with the relatively thick portions constituting the positive lens segments and with the relatively thin portions constituting the negative lens segments.

26. A zoomable beamspreader as defined in claim 22, wherein the alternating positive and negative lens segments of both the first lens and the second lens are cylindrical and arranged in a linear, side-by-side array.

27. A zoomable beamspreader as defined in claim 26, wherein:

the alternating positive and negative lens segments of both the first lens and the second lens all have substantially the same transverse width; and one of the first and second lenses is movable relative to the other in a direction orthogonal to the optical axis by an amount corresponding to the transverse widths of the positive and negative lens segments of the first and second lenses.

28. A zoomable beamspreader as defined in claim 22, wherein the alternating positive and negative lens segments of the first and second lenses are arranged in a two-dimensional array.

29. A zoomable beamspreader as defined in claim 28, wherein:

the alternating positive and negative lens segments of the first and second lenses are rectangular and are arranged in a two-dimensional array having perpendicular first and second axes; and one of the first and second lenses is controllably movable relative to the other lens, along the first and second axes, to controllably adjust the spread angle of an incident collimated beam of light in two dimensions.

30. A zoomable beamspreader as defined in claim 28, wherein:

the alternating positive and negative lens segments of both the first lens and the second lens are arranged in a polar configuration having orthogonal radial and circumferential axes, with a lens centerline thereby being defined in each lens;

the first and second lenses are oriented with their centerlines substantially aligned with each other; and one of the first and second lenses is controllably rotatable relative to the other, about the substantially aligned lens centerlines, to controllably adjust the spread angle of an incident collimated beam of light.

31. A zoomable beamspreader as defined in claim 30, wherein the first lens and second lenses each have thicknesses that vary substantially sinusoidally along both the radial axis and the circumferential axis.

32. A zoomable beamspreader as defined in claim 31, wherein the substantially sinusoidal thickness variation of the first and second lenses along their radial axes has both an amplitude and a period that increase with increasing radius.

33. A zoomable beamspreader as defined in claim 30, wherein the first lens and the second lens each further include a substantially circular, spheric or aspheric lens segment concentric with the lens centerline.

34. A zoomable beamspreader as defined in claim 22, wherein the first and second lenses each have two surfaces that are substantially free of any slope discontinuities.

35. A zoomable beamspreader as defined in claim 22, wherein the first and second lenses are constrained to movement relative to each other only in a direction substantially perpendicular to the optical axis.

36. A zoomable beamspreader as defined in claim 22, and further comprising:

a lamp;

a concave reflector positioned in a predetermined position relative to the lamp such that the lamp and reflector combine to produce a beam of light;

a support structure for supporting the lamp and the reflector in a predetermined position relative to the first and second lenses, such that the beam of light is directed toward the first and second lenses, whereupon the lenses function to spread the beam of light by a controllable amount.

* * * * *